United States Patent [19]

Adamik

[11] Patent Number: 4,516,337

[45] Date of Patent: May 14, 1985

[54] MEANS FOR DISPLAYING A PICTURE OR THE LIKE IN A SHOE

[75] Inventor: Jaroslav Adamik, Santa Ana, Calif.

[73] Assignee: San Shoe Trading Corp., New York, N.Y.

[21] Appl. No.: 548,877

[22] Filed: Nov. 4, 1983

[51] Int. Cl.[3] ..... G09F 03/18; A43B 23/24

[52] U.S. Cl. ..... 36/136; 36/132; 40/159; 2/245; 2/247

[58] Field of Search ..... 36/136, 132, 1; 2/244, 2/245, 246, 249; 40/159

[56] References Cited

U.S. PATENT DOCUMENTS

| | | | |
|---|---|---|---|
| 1,520,224 | 12/1924 | Bush | 36/1 |
| 1,810,649 | 6/1931 | Elliott | 40/159 |
| 1,952,409 | 3/1934 | Berg | 36/136 |
| 2,801,477 | 8/1957 | Adams et al. | 36/136 |
| 2,871,485 | 2/1959 | Greco | 2/246 |
| 2,986,743 | 6/1961 | Eilen | 2/247 |
| 3,055,133 | 9/1962 | Anderson | 2/246 |
| 3,829,995 | 8/1974 | Fakoury | 40/159 |

*Primary Examiner*—Werner H. Schroeder
*Assistant Examiner*—Steven N. Meyers
*Attorney, Agent, or Firm*—Arthur A. March

[57] ABSTRACT

A shoe having means for displaying a picture or the like comprising a saddle portion having an inner and outer wall, a window in the outer wall, a plastic element secured to the perimeter of the window; a pocket formed by joining the three edges of the window and plastic element to the inner wall with one edge remaining unattached to form an entranceway for the insertion of a display into said pocket; a shoelace carrier comprising an inner member which may be an extension of the inner wall of the saddle and an outer member; the lower edge of the inner member being attached to the upper edge of the inner wall of the saddle or being a part of said inner wall, and the lower edge of the outer member being attached to the outer wall of the saddle; an entranceway to the pocket formed between the inner and outer members of the shoelace carrier and contiguous eyelets in the inner and outer member of the shoelace carrier accommodating a shoestring whereby when the shoestring is laced through the eyelets and tightened the entranceway to the pocket is closed thereby preventing exposure of the display in the pocket to the elements and to dirt and debris.

15 Claims, 4 Drawing Figures

MEANS FOR DISPLAYING A PICTURE OR THE LIKE IN A SHOE

BACKGROUND OF THE INVENTION

This application relates to means for displaying a picture or the like on a shoe and particularly a flexible shoe such as a sneaker.

Heretofore, several proposals have been made which relate to the visual display of a picture or the like on a shoe. These displays were usually in the form of a separate outwardly accessible side pocket disposed on the upper side portion of the shoe into which the picture was inserted. A pocket was provided by a separate plastic piece secured by stitching or the like to the outside surface of the upper portion or saddle of the sneaker or to some other portion thereof. Either the top or the side edge of the pocket was not stitched to the shoe thereby providing an opening slit into which the pictue or other visual display was inserted. The following U.S. patents disclose such structure: U.S. Pat. Nos. 4,280,287, 2,801,477, 1,952,409 and 1,100,758.

Other U.S. patents such as U.S. Pat. Nos. 2,154,410 and 1,320,683 deal with outwardly disposed pockets in remote arts such as negative holders and album leaves.

While these means for providing for the display of a picture or the like in these prior art disclosures was functionally satisfactory for display purposes, there is no protection provided against the elements or against the ingress of dirt and debris through the aperture into the pocket itself. As a consequence, the picture or other visual display would soon become soggy and dirty and both the display and the shoe were unsightly and unattractive.

Furthermore, in the course of conventional use of the shoe the picture or other visual display became dislodged due to vibratory action whereupn it could pass out of the pocket through the aperture and be lost or it could wrinkle within the pocket itself.

The present invention overcomes these problems of the prior art and provides a visual display area on the saddle or upper side portion of the sneaker or other flexible shoe means which is not exposed to the elements or the dirt and debris which might be encountered during the use of the shoe. Furthermore, the visible display is held firmly in position during the running use and is not dislodged by vibratory or abrasive action.

SUMMARY OF THE INVENTION

The present invention accomplishes the desired results by providing a unique and novel structure in which the saddle or upper portion of the shoe comprises an inner wall and an outer wall. A window is provided in the outer wall and a plastic element is secured around its outer edges to the outer edges of the window to provide means for visually displaying an article disposed rearwardly thereof. One of the shoelace carrier portions of the shoe located above the saddle is also formed with an inner and outer member. The outer member of the shoelace carrier is secured to the outer wall of the saddle along the upper edge of said wall. The inner member of the shoelace carrier is part of or is secured to the inner wall of the saddle along the upper edge of said wall. A pocket is provided by securing three edges of the window, plastic element and inner wall together while leaving one edge open. Access to this pocket is had through the opening which exists between the inner and outer members of the shoelace carrier to the space between the inner and outer walls of the saddle and rearwardly of the plastic element. After insertion, the display in the form of a picture or the like is thus visible through the plastic piece. With the display in position, the shoelaces are passed through eyelets provided in the inner and outer members of one of the shoelace carriers and, when laced, the shoelace carriers are joined tightly together to completely and effectively cover the entranceway to the pocket. As a consequence, the contents of the pocket are in no way exposed to the elements or to the dirt or debris.

While the invention has been described hereinafter in detail with reference to the specific drawings, it is to be understood that this description is merely for the purpose of facilitating an understanding of the invention and is not construed as any limitation thereon.

DETAILED DESCRIPTION OF THE INVENTION

Figure 1:
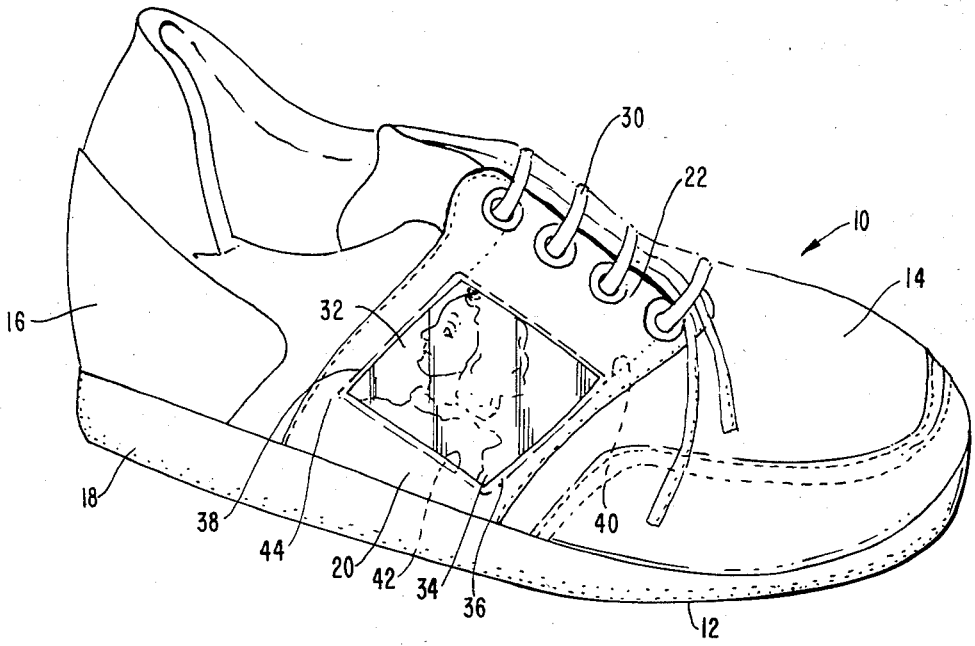
FIG. 1 is a side view of a shoe in the form of a sneaker showing the display pocket on the saddle with a picture displayed therein.
Figure 2:
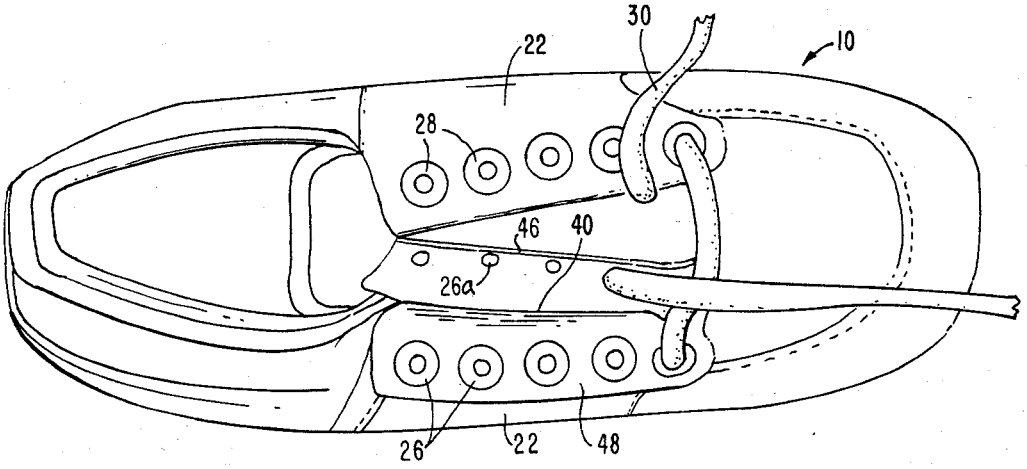
FIG. 2 is a top view of the shoe of the present invention showing the disposition of the display pocket with the shoelace tied.

The present invention presents a completely effective way for providing a visible display on the upper side of saddle portion of a flexible shoe without the display being exposed to the elements and to the ingress of dirt and other debris. The invention will be described in connection with a sneaker, although other types of shoes may be used and the term "sneaker", as used herein, shall include such other type shoes.

As shown in the drawings a conventional sneaker 10 has a sole portion 12 and upper front and rear portions 14 and 16 as well as a heel portion 18. Extending between front and rear portion and upper side panels are saddles 20 formed of an inner wall 24 and an outer 22. Shoelace carriers as hereinafter described are disposed over the upper edges of the saddles 20 having eyelets 26 and 28 through which a shoestring 30 passes when the shoe is laced. A tongue 33 is disposed below the aperture provided between the shoelace carriers to protect the wearer's foot against exposure to the elements.

Heretofore, visual display pockets have been suggested for attachment to the upper side or saddle of the sneaker. Such pockets have been in the form of a plastic piece which is sewn along three sides to the upper saddle. Either the upper portion or one of the side portions of the plastic piece remains detached to form a slit or entranceway to accommodate the insertion of the picture or other display into the pocket. However this entrance to the pocket permits exposure, is outwardly directed and remains open permitting exposure of the contents to the elements as well as to the dirt and other debris encountered with the conventional use of the sneaker.

According to the present invention a new and novel pocket structure is provided for carrying the display. As aforesaid, the shoe has a saddle or upper portion 20 formed of an inner wall 24 and outer wall 22. The outer wall 22 has a window 32 disposed substantially central of said wall. A plastic element 34 is secured along its entire outer perimeter 36 to the outer perimeter 38 of the window 32 by stitching or other suitable fastening means.

The inner wall 24 of the saddle 20 is located on a plane rearwardly of the window 32 and is attached to the outer wall 22 in such fashion as to provide a slit 40 which is the entranceway to a display pocket 42 between the inner and outer walls in the manner hereinafter described.

One side of the shoelace carrier 44 comprises an inner member 46 and an outer member 48. While the inner member is designated separately, it may be an intergral part of the inner wall 24 of the saddle 20 as illustrated. Both of the inner and outer members are provided with contiguous eyelets 26 and 26*a*. The inner member 46 of the shoelace carrier, when separate, is secured along its lower edge to the upper edge of the inner wall 24 of the saddle 20 as it may be an integral part of said wall. The outer member 48 is secured along its lower edge of the upper edge of the outer wall 22 of the saddle. A portion of the inner and outer members are not fastened together in order to provide an entranceway 40 leading to the display pocket 42 which is formed as follows:

The inner wall 24 of the saddle is secured to the lower and side edges of both the window 32 and the plastic element 34. This securement is accomplished by stitching as shown although any other suitable fastening means may be utilized. The upper edges of the window 32 and the plastic element 34 are not secured to the inner wall. By this construction the pocket 42 is formed and the slit or entranceway 40 is open into the pocket to provide for the insertion and reception of the display 50. Thus the display is, in effect, nestled between the inner wall 24 of the saddle which is not exposed to the elements and from the front by the plastic member which is impervious to the elements.

Figure 3:
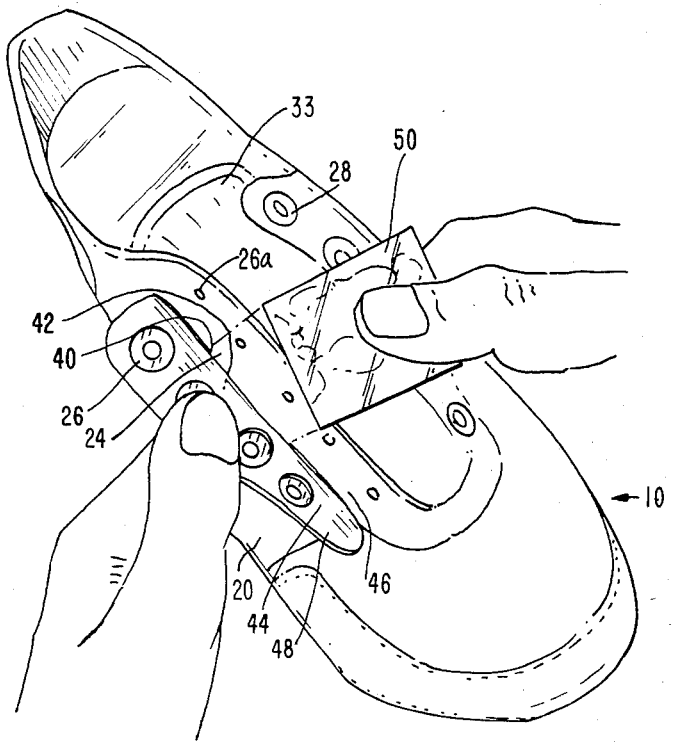
FIG. 3 is a perspective view of the shoe of the present invention showing the structure provided for positioning the display in the pocket.
Figure 4:
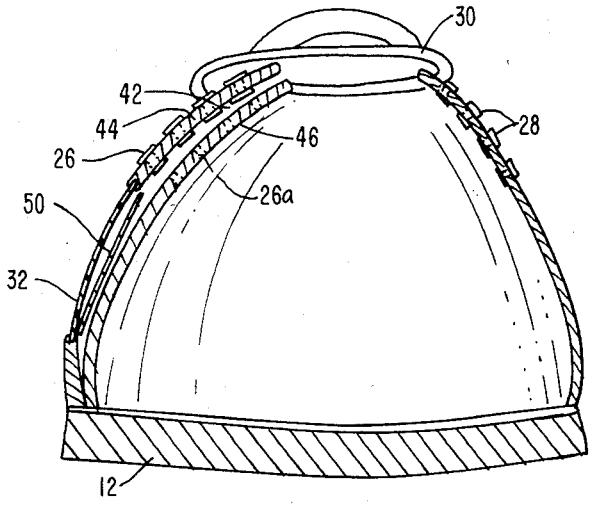
FIG. 4 is a sectional view taken along the lines of FIG. 3.

As shown in FIG. 3 the display 50 is inserted into the pocket 42 through the entranceway 40 that exists between the inner and outer members 46 and 48 of the shoelace carrier and the inner and outer walls 24 and 22 of the saddle 20. Thereafter a shoestring 30 is laced through the eyelets 26, 26*a* and 28 and then tightened and tied in the usual fashion. When this is accomplished the shoelace carriers 46 and 48 as well as the saddle portion 20 secured thereto are tightened around the upper portion of the foot. This action serves to close the slit or entranceway 40 which is then not exposed to the elements nor to any dirt nor debris encounter during the use of the sneaker.

Hence, the shoelace carrier members 46 and 48 serve as cooperating reception means carried by the saddle 20 at the front and rear the front and rear thereof, i.e. at the inner and outer walls 24 and 22, and adjacent the slit or entranceway 40 of the pocket 42 for correspondingly receiving securing means, e.g. shoestring 30 via eyelets 26 and 26*a*, for securing the shoe on the wearer, e.g. in conjunction with eyelets 28 on the opposite lateral side of the shoe, and for simultaneously closing and securing the slit or passageway 40.

While the slit or entranceway 40 is shown as extending along the upper edge of the pocket structure it is possible to provide the slit along one of the side edges. In this event the upper, lower and one side edge of the window and plastic member are secured to the inner wall and another side edge of the window and plastic member remain unattached and reachable through the space forming the entranceway that exists between the inner and outer members 46 and 48 of the shoelace carrier.

By the foregoing construction a unique structure of a display carrier pocket for shoes is provided which prevents the ingress of foreign substances including inclement weather from entering into the pocket and causing damage to the display. The structure also maintains the pocket in a relatively tight position against the foot whereby movement of the picture in any direction is inhibited despite the flexing of the shoe in use.

It is to be understood that while the invention has been described in detail, with respect to one embodiment, modifications may be made without departing from the support of the invention as set forth in the appended claims.

What is claimed is:

1. Shoe having means for providing a visual display comprising a saddle portion having a front and a rear, a window in said saddle portion, a plastic element adjacent to said window, a pocket formed along the rear of said plastic element and said window, said pocket including an entranceway accessible from the rear of said saddle portion, and cooperating reception means carried by said saddle portion at the front and rear thereof and adjacent the entranceway of said pocket for correspondingly receiving securing means for securing the shoe on the wearer and for simultaneously closing said passageway, thereby preventing exposure of said pocket to the elements or dirt and debris.

2. Shoe of claim 1 wherein the plastic element is secured to the window in the saddle portion.

3. Shoe of claim 2 wherein the saddle portion comprises an inner and an outer wall spaced from each other, and the reception means includes a shoelace carrier comprising an outer member and an inner member provided with contiguous eyelets, such that the outer member of the shoelace carrier forms a part of the outer wall of the saddle portion and the inner member of the shoelace carrier forms a part of the inner wall of the saddle portion, said outer and inner members having portions spaced apart from each other and disposed above the entranceway to said pocket.

4. Shoe of claim 3 wherein the inner member of the shoelace carrier forms an integral part of the inner wall of the saddle portion.

5. Shoe of claim 3 wherein the outer member of the shoelace carrier is a separate piece secured along its lower edge to the upper edge of the outer wall of the saddle portion, and the inner member of the shoelace carrier is a separate piece secured along its lower edge to the upper edge of the inner wall of the saddle portion.

6. Shoe provided with means for carrying a visual display comprising a sole portion, a saddle portion comprising an inner wall and an outer wall, the outer wall being provided with a window, a plastic element secured to the window, a pocket formed between the inner wall and the plastic element, the pocket having an entranceway for the insertion of a display and its accommodation within the pocket, and cooperating reception means carried by the inner wall and outer wall of the saddle portion and adjacent the entranceway of the pocket for correspondingly received securing means for securing the shoe to the wearer and for simultaneously closing and securing said passageway, to prevent exposure of the contents of said pocket to the elements of dirt and debris.

7. Shoe of claim 6 including fastening means extending along substantially the outer perimeter of the plastic element and the window to secure them together.

8. Shoe of claim 6 including fastening means extending through a plurality of edges of the plastic element, the window and the inner wall of the saddle portion, with one edge of the plastic element and the same edge of the window being unattached to the inner wall of the saddle portion to provide a slit for the insertion of a display into the pocket.

9. Shoe of claim 8 wherein the unattached edges of the plastic element and the window are the upper edges thereof.

10. Shoe of claim 9 including shoelace carriers, one of which comprises the reception means and includes an inner member secured to the inner wall of the saddle portion and an outer member secured to the outer wall of the saddle portion, said members being arranged above the entranceway to the pocket and in spaced relation to each other to permit access to the entranceway.

11. Shoe of claim 10 including eyelets in the shoelace carriers and a shoestring threaded through the eyelets such that when the shoestring is tightened is causes the entranceway to close.

12. Shoe having means for providing a visual display comprising a saddle portion having an outer wall and an inner wall, the outer wall being provided with a visual display window having a plastic element secured thereto, a pocket formed between the inner wall and the plastic element and having an entranceway for the insertion of a display and its accommodation in the pocket, an outer reception means carried by the outer wall and an inner reception means carried by the inner wall, the outer and inner reception means being arranged adjacent the entranceway of the pocket and cooperating with each other for correspondingly receiving securing means for securing the shoe to the wearer and for simultaneously closing and securing the passageway, to prevent exposure of the contents of the pocket to the elements or dirt and debris.

13. Shoe of claim 12 including shoe securing means carriers, one of which carriers comprises the reception means and includes an inner reception member secured to the inner wall of the saddle portion and an outer reception member secured to the outer wall of the saddle portion, the reception members being arranged above the entranceway to the pocket and in spaced relation to each other to permit access to the entranceway, the shoe securing means carriers being arranged to receive securing means for securing the shoe to the wearer and for simultaneously closing and securing the entranceway by securing the reception members to each other.

14. Shoe of claim 13 wherein the shoe securing means carriers are provided with securing means for securing the carriers together and the reception means to each other for thereby securing the shoe to the wearer and closing and securing the entranceway.

15. Shoe of claim 14 wherein the shoe securing means carriers are shoelace carriers provided with shoelace receiving means and the securing means is a shoestring.

* * * * *